US011121503B1

(12) United States Patent
Kan et al.

(10) Patent No.: US 11,121,503 B1
(45) Date of Patent: Sep. 14, 2021

(54) QUICKLY ASSEMBLED CABLE CONNECTOR

(71) Applicant: KINSUN INDUSTRIES INC., Taoyuan (TW)

(72) Inventors: Ching-Neng Kan, Taoyuan (TW); Yi-Hung Chang, Taoyuan (TW); Li-Chin Yang, Taoyuan (TW)

(73) Assignee: KINSUN INDUSTRIES INC., Taoyuan (TW)

( * ) Notice: Subject to any disclaimer, the term of this patent is extended or adjusted under 35 U.S.C. 154(b) by 0 days.

(21) Appl. No.: 16/930,271

(22) Filed: Jul. 15, 2020

(51) Int. Cl.

| | |
|---|---|
| ***H01R 13/627*** | (2006.01) |
| ***H01R 13/629*** | (2006.01) |
| ***H01R 13/502*** | (2006.01) |
| ***H01R 13/639*** | (2006.01) |
| *H01R 13/52* | (2006.01) |

(52) U.S. Cl.
CPC ..... *H01R 13/627* (2013.01); *H01R 13/502* (2013.01); *H01R 13/629* (2013.01); *H01R 13/639* (2013.01); *H01R 13/52* (2013.01); *H01R 13/6276* (2013.01)

(58) Field of Classification Search
CPC ..... H01R 13/627; H01R 13/6276; H01R 13/502; H01R 13/629; H01R 13/639; H01R 13/52
See application file for complete search history.

(56) References Cited

U.S. PATENT DOCUMENTS 4,824,386 A * 4/1989 Souders ..... H01R 13/625 439/133
4,846,714 A * 7/1989 Welsby ..... H01R 13/62 439/348
8,939,786 B2 * 1/2015 Rosenberger ..... H01R 13/6277 439/352

* cited by examiner

*Primary Examiner* — Tho D Ta

(57) ABSTRACT

A quickly assembled cable connector includes a mounting device set including a first mounting device and a second mounting device, a pressing device set including a guide member and a pressing member and mounted in the second mounting device, and a cable inserted properly through the first mounting device, the guide member, the pressing member and the second mounting device for allowing the tubular plug portion of the second mounting device to be plugged into the first mounting device so that the first mounting device and the second mounting device squeeze an object therebetween, the first mounting device pushes the pressing member toward the guide member, and the clamping neck is forced inwardly by the guide member to clamp the cable in position.

7 Claims, 8 Drawing Sheets

QUICKLY ASSEMBLED CABLE CONNECTOR

BACKGROUND OF THE INVENTION

1. Field of the Invention

The present invention relates to cable connector technology and more particularly, to a quickly assembled cable connector that can quickly locate the cable on an object.

2. Description of the Related Art

Coaxial cables or cables are connected to electronic products or electrical products using cable connectors. The conventional cable connector uses a fastener to position the connector body on the electronic product or electrical product. After the cable passes through the connector body, the connector body is fixed by the lock nut to allow the connector body to shrink and hold the cable in position. This method is inconvenience due to a secondary construction. Due to the shrinking design to clamp the cable, the waterproof effect is not perfect.

SUMMARY OF THE INVENTION

The present invention has been accomplished under the circumstances in view. It is therefore the main object of the present invention to provide a quickly assembled cable connector, which uses a pressing device in a mounting device set for letting the mounting device set hold an object and simultaneously force the pressing device to clamp the cable in position, facilitating application and achieving a waterproof effect.

To achieve this and other objects of the present invention, a quickly assembled cable connector comprises a mounting device set, a pressing device set and a cable. The mounting device set comprises a first mounting device and a second mounting device. The second mounting device comprises a tubular plug portion located at one end thereof, and a tubular grip portion located at an opposite end thereof. The pressing device set is mounted in the tubular plug portion of the mounting device set, comprising a guide member and a pressing member. The pressing member comprises a push portion, and a clamping neck axially extended from one end of the push portion and disposed near the guide member. The cable is inserted in a proper order through the first mounting device, the guide member, the pressing member and the second mounting device for allowing the tubular plug portion of the second mounting device to be plugged into the first mounting device so that the first mounting device and the second mounting device squeeze an object therebetween, the first mounting device pushes the pressing member toward the guide member, and the clamping neck is forced inwardly by the guide member to clamp the cable in position.

DETAILED DESCRIPTION OF THE PREFERRED EMBODIMENT

Figure 1:
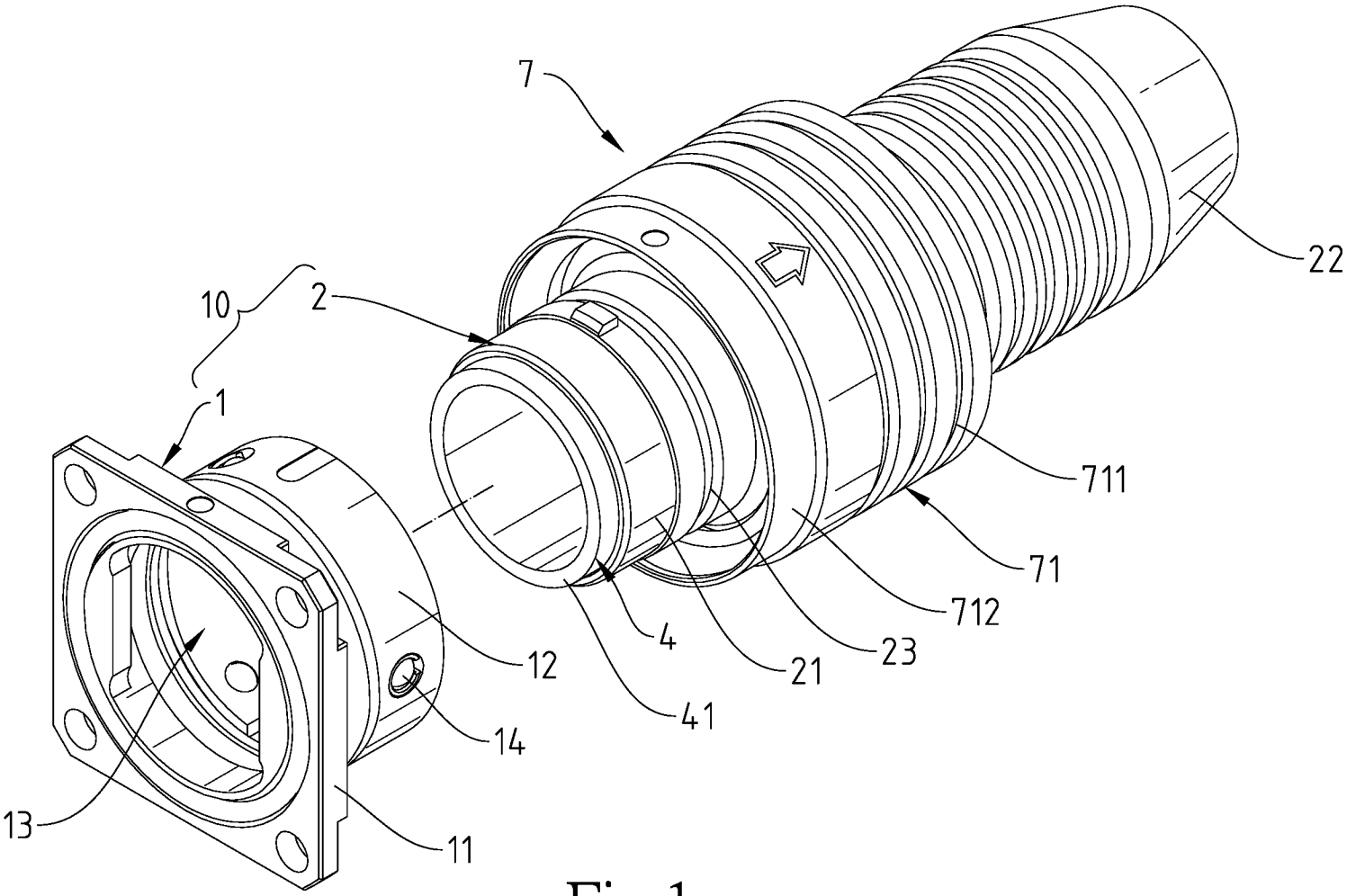
FIG. 1 is an elevational view of a quickly assembled cable connector in accordance with the present invention.
Figure 2:
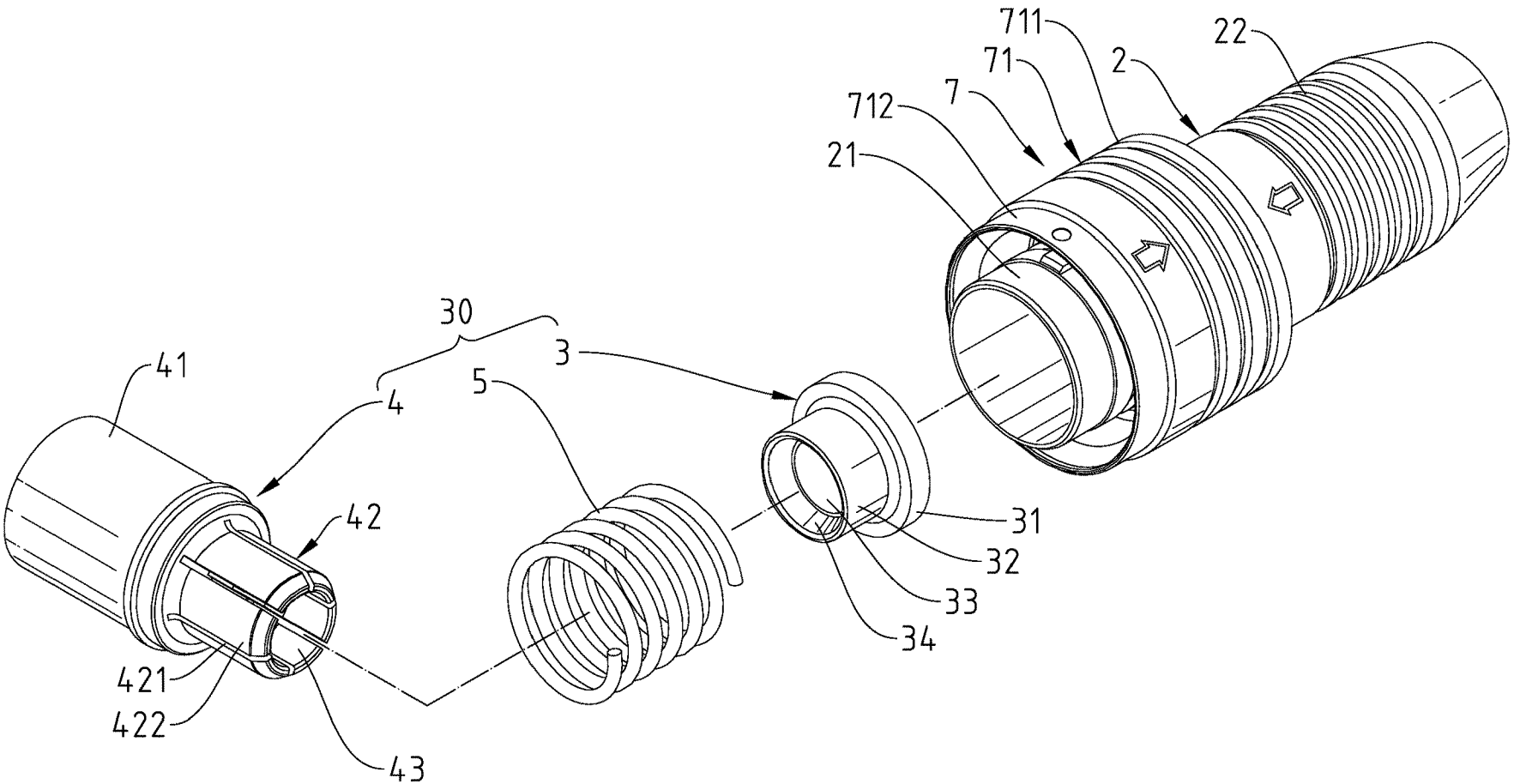
FIG. 2 is an exploded view of the pressing device set.
Figure 3:
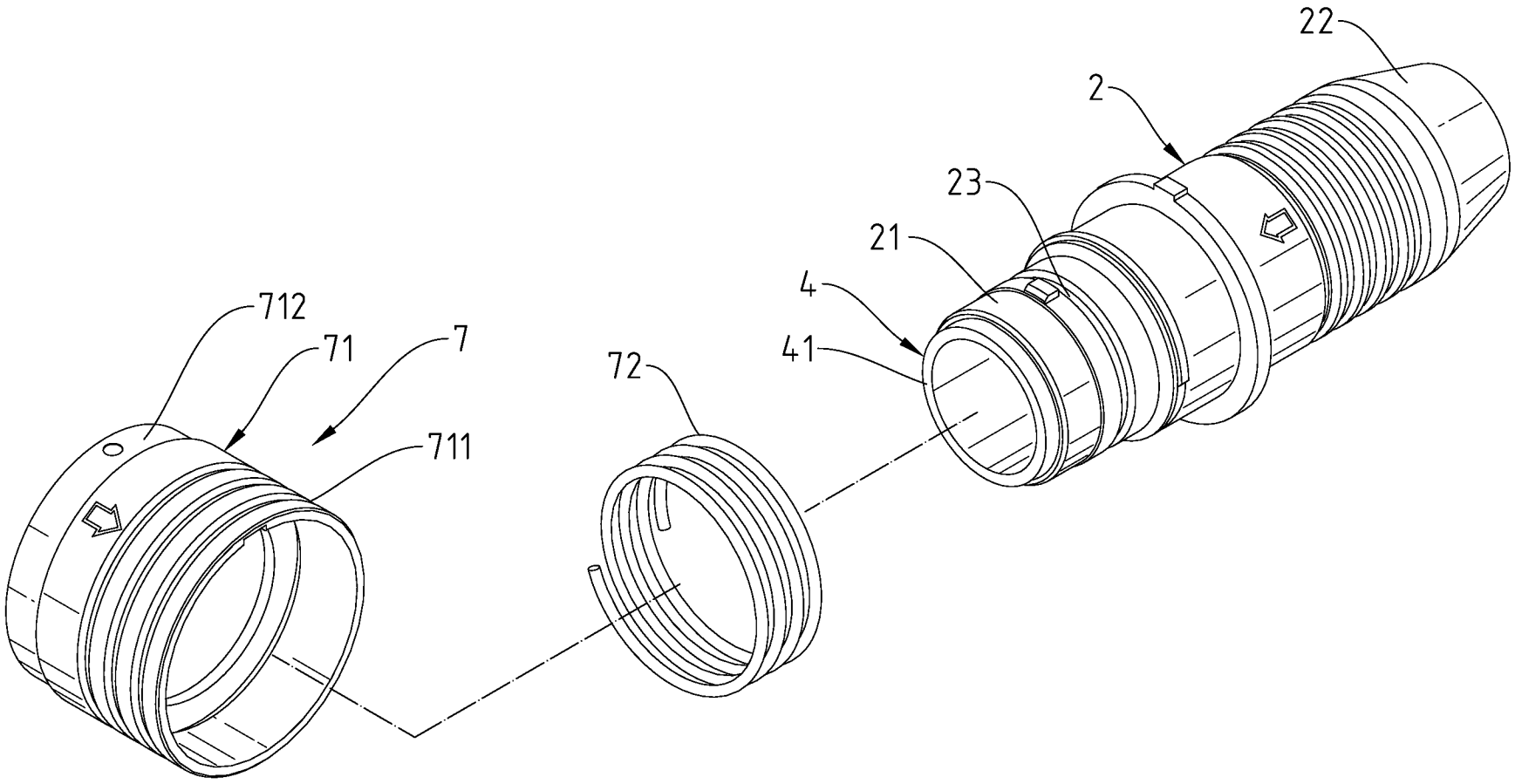
FIG. 3 is an exploded view of the unlocking device set.

Referring to FIGS. 1-4, a quickly assembled cable connector 10 in accordance with the present invention generally comprises a mounting device set 10, a pressing device set 30 and an unlocking device set 7.

The mounting device set 10 comprises a first mounting device 1 and a second mounting device 2. The first mounting device 1 comprises a mounting base 11, a socket 12 fixedly extended from one side of the mounting base 11, a first insertion space 13 axially cut through the mounting base 11 and the socket 12, a plurality of positioning elements 14 mounted in and equiangularly spaced around the socket 12 and radially movable in and out of the first insertion space 13, and a first waterproof washer 8 mounted within the socket 12. The second mounting device 2 comprises a tubular plug portion 21 located at one end thereof, a tubular grip portion 22 located at an opposite end thereof, a plurality of positioning grooves 23 located on and equiangularly spaced around the outer periphery of the tubular plug portion 21, and a second waterproof washer 9 mounted within the tubular grip portion 22.

The pressing device set 30 is mounted in the tubular plug portion 21 of the mounting device set 10, comprising a guide member 3, a pressing member 4 and a first elastic member 5. The pressing member 4 comprises a push portion 41, a clamping neck 42 axially extended from one end of the push portion 41, a pressing insertion space 43 axially extended through the push portion 41 and the clamping neck 42, a plurality of slits 421 longitudinally formed on the clamping neck 42 and separating the clamping neck 42 into a plurality of equiangularly spaced clamping strips 422 that are respectively provided with an inner engagement portion 423. The guide member 3 is disposed near the clamping neck 42 of the pressing member 4, comprising a guide base 31, a guide portion 32 extended from one side of the guide base 31, a guiding insertion space 33 axially cut through the guide base 31 and the guide portion 32 and a tapered guide surface 34 formed in the distal end of the guide portion 32 and facing the guiding insertion space 33. The first elastic member 5 is mounted around the guide portion 32 of the guide member 3 and the clamping neck 42 of the pressing member 4. Furthermore, the end of the push portion 41 of the pressing member 4 is exposed by the end of the tubular plug portion 21 of the second mounting device 2 of the mounting device set 10.

The unlocking device set 7 is mounted around the tubular plug portion 21 of the second mounting device 2 of the mounting device set 10, comprising an unlocking socket 71 and a second elastic member 72. The unlocking socket 71 comprises an unlocking base 711 and a stop portion 712 extended from one end of the unlocking base 711. The unlocking socket 71 is attached onto the tubular plug portion 21 of the second mounting device 2 to keep the stop portion 712 in alignment with the positioning grooves 23 of the second mounting device 2. The second elastic member 72 is mounted between the tubular plug portion 21 and the unlocking socket 71.

Figure 4:
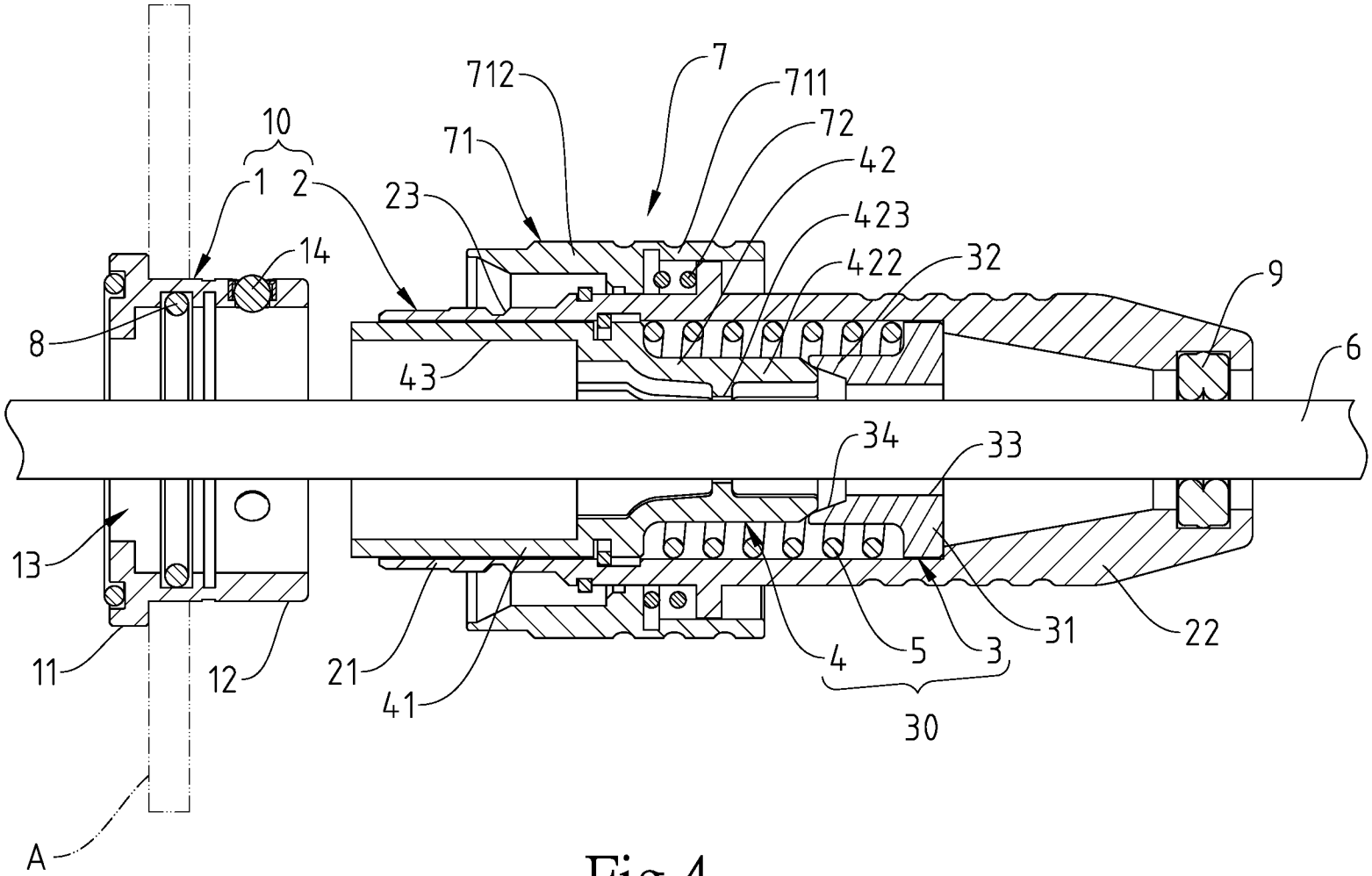
FIG. 4 is a schematic drawing of the present invention, illustrating the first mounting device affixed to an object.
Figure 5:
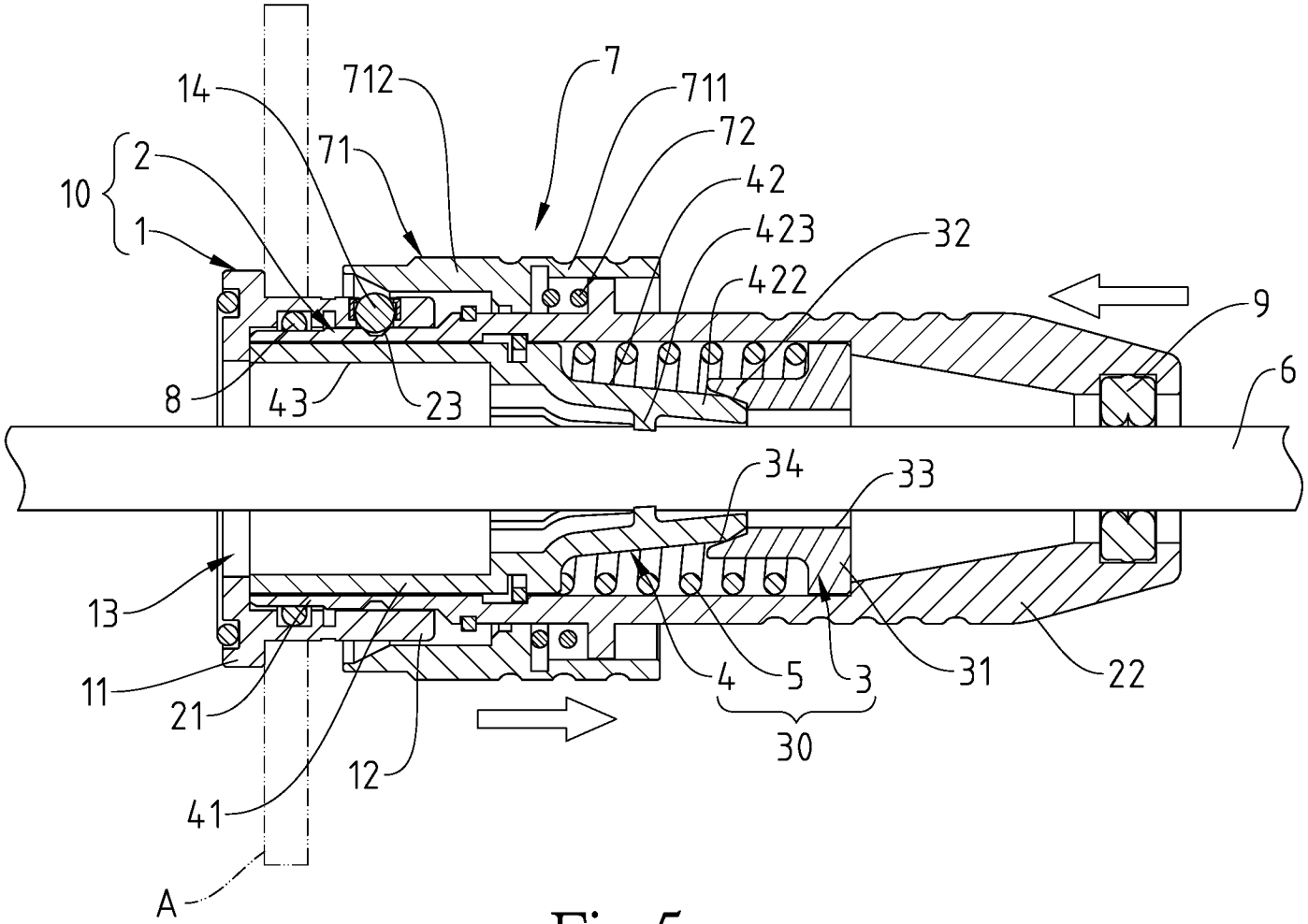
FIG. 5 is a schematic drawing of the present invention, illustrating the second mounting device inserted into the first mounting device.
Figure 6:
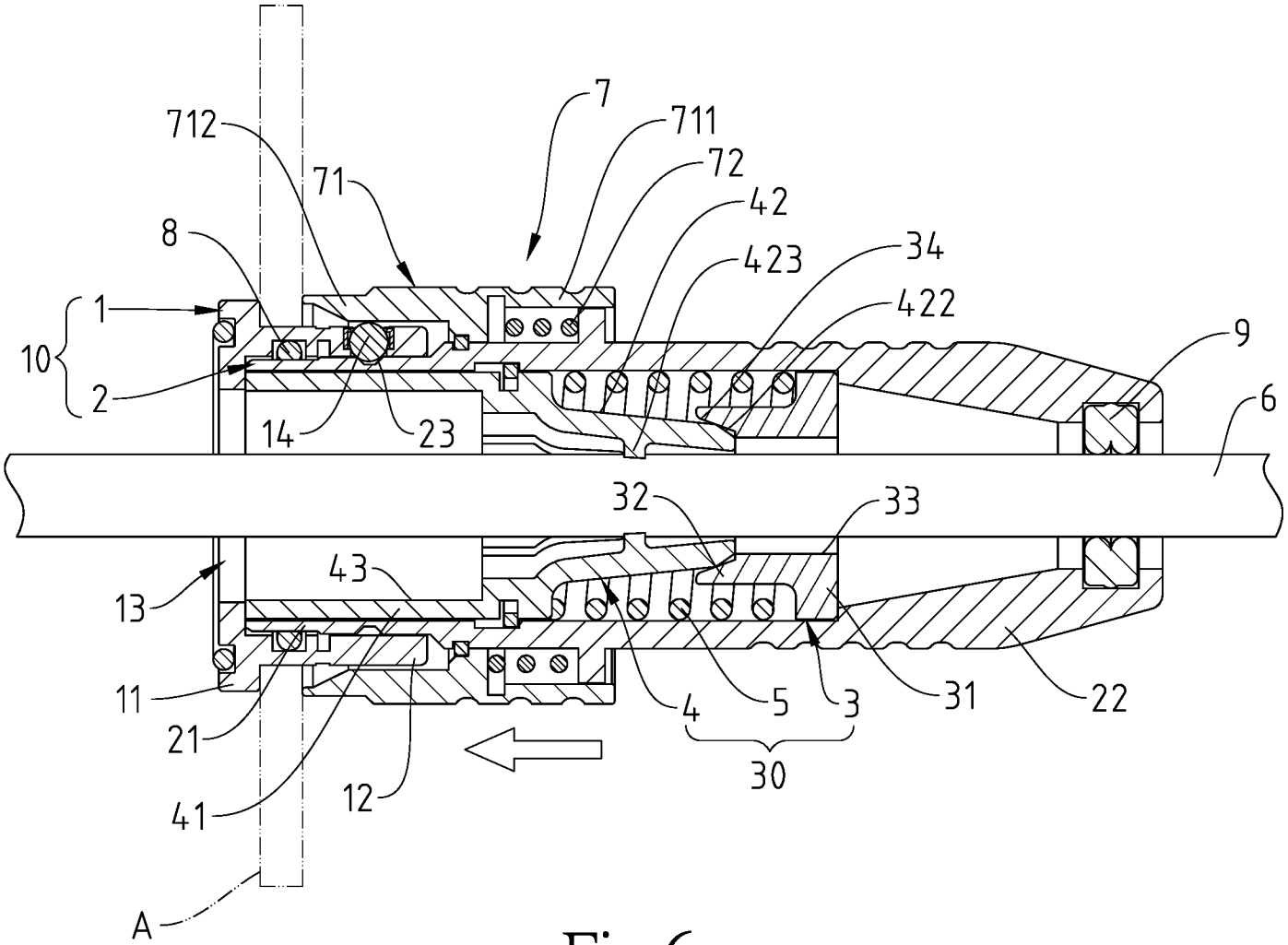
FIG. 6 is a schematic drawing of the present invention, illustrating the first mounting device and the second mounting device positioned.

Referring to FIGS. 4-6, as illustrated, when the quickly assembled cable connector 10 is used, firstly affix the first mounting device 1 to one side of an object A and place the second mounting device 2 on an opposite side, then insert the cable 6 in a proper order through the second waterproof washer 9, the guiding insertion space 33, the pressing insertion space 43 and the first insertion space 13, and then plug the tubular plug portion 21 of the second mounting device 2 into the socket 12 of the first mounting device 1 to move the positioning elements 14 of the first mounting device 1 radially and partially out of the outer perimeter of the socket 12, causing displacement of the stop portion 712 and compression of the second elastic member 72 so that the positioning grooves 23 can be exposed by the stop portion 712. When continuously forcing the tubular plug portion 21 of the second mounting device 2 toward the inside of the socket 12 of the first mounting device 1, the positioning elements 14 will engage the respective positioning grooves 23, and the elastic restoring energy of the second elastic member 72 will push the unlocking socket 71 back to its former position, so that the stop portion 712 stops the positioning elements 14 in the socket 12 to lock the first mounting device 1 and the second mounting device 2 in position. At this time, the first waterproof washer 8 is closely attached to the surface of the tubular plug portion 21 of the second mounting device 2. Furthermore, when the second mounting device 2 is plugged into the first mounting device 1, the mounting base 11 of the first mounting device 1 pushes the push portion 41 of the pressing member 4 to move the pressing member 4 toward the guide member 3, so that the ends of the clamping strips 422 contact the tapered guide surface 34 and are guided by the tapered guide surface 34 to form a retracted shape, and then the clamping strips 422 clamp the cable 6 in position, and at the same time, the inner engagement portions 423 will also be forced into engagement with the cable 6.

Figure 7:
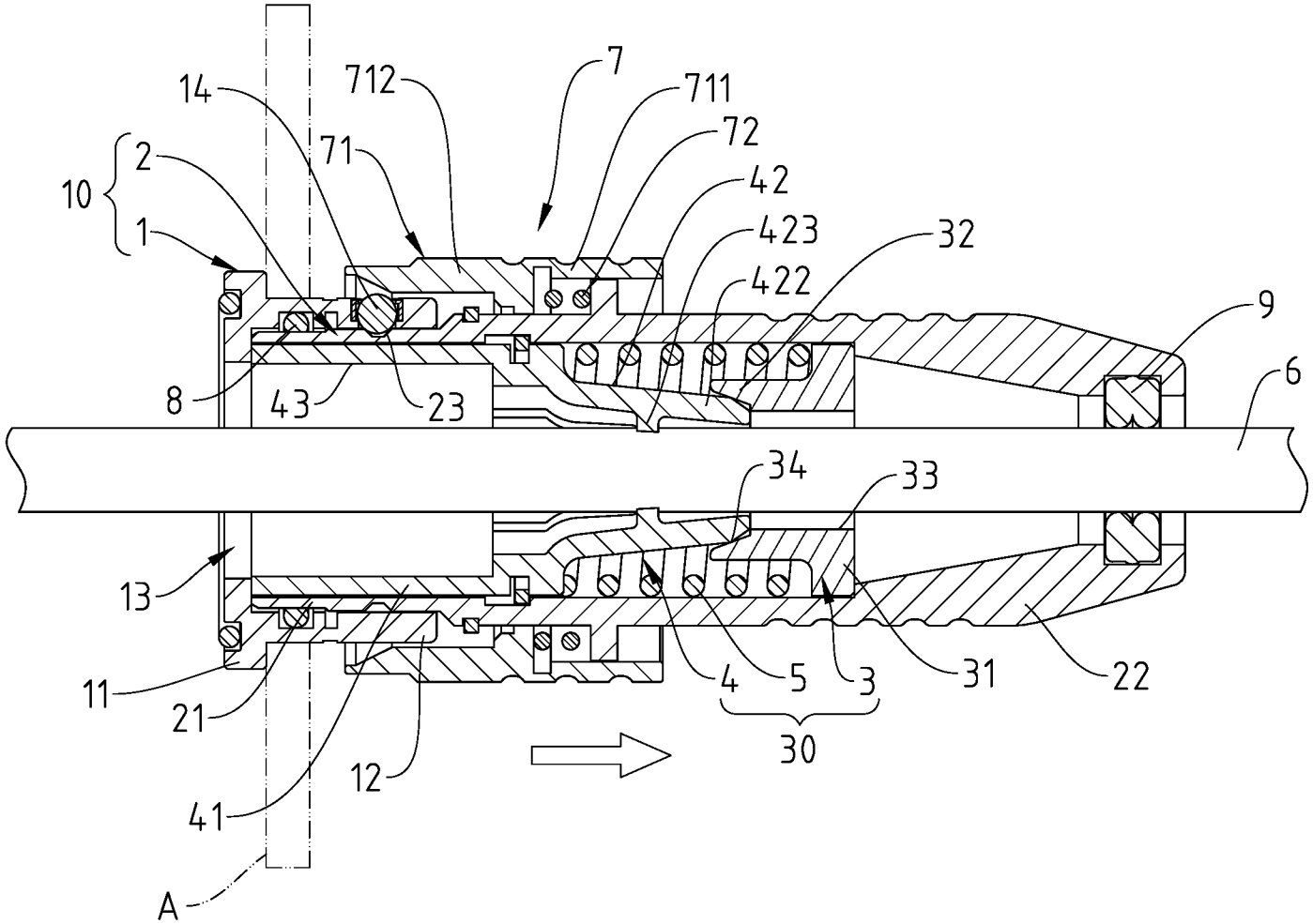
FIG. 7 is a schematic drawing of the present invention, illustrating the first mounting device and the second mounting device unlocked.
Figure 8:
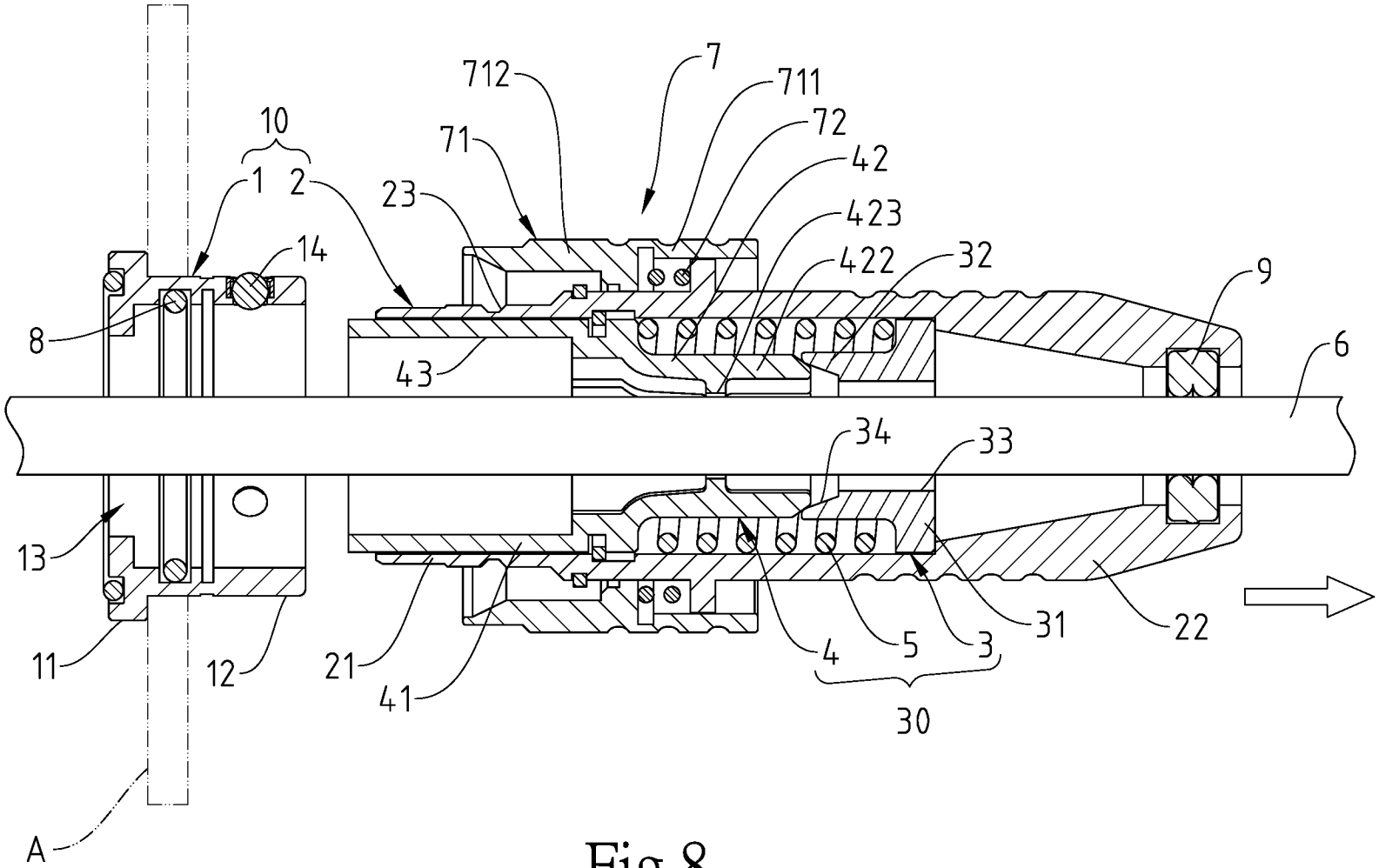
FIG. 8 is a schematic drawing of the present invention, illustrating the first mounting device and the second mounting device separated from each other.

Referring to FIGS. 7 and 8, as illustrated, when detaching the first mounting device 1 and the second mounting device 2, pull the unlocking socket 71 to move the stop portion 712 and to elastically deform the second elastic member 72, enabling the positioning grooves 23 to be exposed outside the stop portion 712. At this time, the positioning elements 14 are disengaged from the respective positioning grooves 23, allowing separation of the second mounting device 2 from the first mounting device 1. When the second mounting device 2 is separated from the first mounting device 1, the pressing member 4 is released from the pushing force of the first mounting device 1 and returned to its former position by the elastically restoring energy of the first elastic member 5, and thus, the cable 6 is released from the clamping force of the clamping strips 422.

What the invention claimed is:

1. A quickly assembled cable connector, comprising:

a mounting device set comprising a first mounting device and a second mounting device, said second mounting device comprising a tubular plug portion located at one end thereof and a tubular grip portion located at an opposite end thereof;

a pressing device set mounted in said tubular plug portion of said mounting device set, said pressing device set comprising a guide member and a pressing member, said pressing member comprising a push portion and a clamping neck axially extended from one end of said push portion and disposed near said guide member; and a cable inserted in a proper order through said first mounting device, said guide member, said pressing member and said second mounting device for allowing said tubular plug portion of said second mounting device to be plugged into said first mounting device so that said first mounting device and said second mounting device squeeze an object therebetween, said first mounting device pushes said pressing member toward said guide member, and said clamping neck is forced inwardly by said guide member to clamp said cable in position.

2. The quickly assembled cable connector as claimed in claim 1, wherein said guide member of said pressing device set comprises a guide base, a guide portion extended from one end of said guide base, a guiding insertion space axially cut through said guide base and said guide portion, and a tapered guide surface formed in the distal end of said guide portion and facing said guiding insertion space; said pressing member of said pressing device set further comprises a pressing insertion space axially cut through said push portion and said clamping neck; said pressing member further comprises a plurality of slits longitudinally formed on said clamping neck and separating said clamping neck into a plurality of equiangularly spaced clamping strips, said clamping strips having respective distal ends thereof disposed near said guide portion of said guide member; said cable is arranged in said guiding insertion space of said guide member and said pressing insertion space of said pressing member; when said first mounting device pushes said pressing member toward said guide member, the distal ends of said clamping strips touch said tapered guide surface and are inwardly forced by said tapered guide surface to clamp said cable in position.

3. The quickly assembled cable connector as claimed in claim 1, wherein each said clamping strip of said pressing member is provided with an inner engagement portion that faces said pressing insertion space for engaging said clamp when said clamping strips clamp said cable in position.

4. The quickly assembled cable connector as claimed in claim 1, wherein said guide member comprises a guide base and a guide portion extended from one side of said guide base; said pressing device set further comprises a first elastic member mounted around said guide portion of said guide member and said clamping neck of said pressing member in such a manner that when said first mounting device pushes said pressing member toward said guide member, said first elastic member is elastically compressed and, when said pressing member is released from said first mounting device, said pressing member is returned by the elastic restoring energy of said elastic member.

5. The quickly assembled cable connector as claimed in claim 1, wherein the distal end of said push portion of said pressing member of said pressing device set is exposed by the distal end of said tubular plug portion of said second mounting device of said mounting device set, so that when said second mounting device is plugged into said first mounting device, said first mounting device pushes said push portion of said pressing member to move said pressing member toward said guide member.

6. The quickly assembled cable connector as claimed in claim 1, wherein said first mounting device of said mounting device set comprises a mounting base, a socket extended from one side of said mounting base, a first insertion space axially cut through said mounting base and said socket, and a plurality of positioning elements mounted in and equiangularly spaced around said socket and radially movable in and out of said first insertion space; said cable is arranged in said first insertion space; said second mounting device of said mounting device set further comprises a plurality of positioning grooves located on and equiangularly spaced around the outer periphery of said tubular plug portion; when said tubular plug portion of said second mounting device is plugged into said socket of said first mounting device, said positioning elements are respectively engaged in said positioning grooves to lock said first mounting device and said second mounting device.

7. The quickly assembled cable connector as claimed in claim 6, further comprising an unlocking device set mounted around said tubular plug portion of said second mounting device of said mounting device set, said unlocking device set comprising an unlocking socket and a second elastic member, said unlocking socket comprising an unlocking base and a stop portion extended from one end of said unlocking base, said unlocking socket being attached onto said tubular plug portion of said second mounting device to keep said stop portion in alignment with said positioning grooves of said second mounting device, said second elastic member being mounted between said tubular plug portion and said unlocking socket; where when said tubular plug portion of said second mounting device is plugged into said socket of said first mounting device, said positioning elements of said first mounting device are forced by said tubular plug portion to partially exposed outside said socket, so that said positioning elements push said stop portion and said second elastic member is elastically compressed, enabling said positioning grooves to be exposed outside said stop portion; after said positioning elements are respectively engaged in said positioning grooves, said unlocking socket is returned by the elastic restoring energy of said second elastic member, and said stop portion stops said positioning element in said socket to lock said first mounting device and said second mounting device in position.

* * * * *